US005336009A

United States Patent [19]

Young

[11] Patent Number: 5,336,009

[45] Date of Patent: Aug. 9, 1994

[54] INK GUIDE FOR A BALLPOINT PEN

[76] Inventor: Jean Young, 2F., No. 52, Tien Shui Road, Taipei, Taiwan

[21] Appl. No.: 58,128

[22] Filed: May 10, 1993

[51] Int. Cl.[5] ..... B43K 7/10

[52] U.S. Cl. ..... 401/209; 401/216

[58] Field of Search ..... 401/209, 216

[56] References Cited

U.S. PATENT DOCUMENTS

| | | | |
|---|---|---|---|
| 2,847,975 | 8/1958 | Lawton | 401/209 X |
| 3,063,420 | 11/1962 | Tefft | 401/209 |
| 4,139,313 | 2/1979 | Hori | 401/216 |
| 4,430,014 | 2/1984 | Tsai | 401/216 |
| 4,770,558 | 9/1988 | Frietsch | 401/209 |

FOREIGN PATENT DOCUMENTS

| | | | |
|---|---|---|---|
| 173131 | 5/1952 | Austria | 401/209 |
| 256615 | 2/1988 | European Pat. Off. | 401/209 |
| 2723032 | 1/1978 | Fed. Rep. of Germany | 401/216 |
| 1564006 | 5/1990 | U.S.S.R. | 401/209 |

*Primary Examiner*—Steven A. Bratlie

*Attorney, Agent, or Firm*—Bacon & Thomas

[57] ABSTRACT

A non-absorbent ink guide is provided which allows a ballpoint pen to replaceably use different ink cartridges of different concentration. The ink guide has channels of different pitches for guiding the ink to the tip thereof and for returning flow of the ink after the tip has been saturated with the ink, a buffer portion to reduce the hydrodynamic pressure and flowing speed of the ink, and a collar to define the distance of the tip to the steel ball of the ballbearing of the ballpoint pen.

4 Claims, 3 Drawing Sheets

INK GUIDE FOR A BALLPOINT PEN

BACKGROUND OF THE INVENTION

The present invention relates to ink guides for ballpoint pens, and more particularly the present invention relates to such an ink guide which allows a ballpoint pen to replaceably use different ink cartridges of different concentration.

Various ballpoint pens have been proposed, and have appeared on the market. FIG. 1 illustrates a ballpoint pen according to the prior art which comprises a reservoir tube filled with ink and held inside a barrel, a ballbearing attached to an absorbent rod, which is connected to the reservoir tube by a connector. The ink is continuously absorbed by the absorbent rod and guided out of the steel ball in the ballbearing during writing. As the absorbent rod keeps absorbing the ink even if it is saturated with the ink, the leakage of the ink may occur easily. There is also known in the prior art another ballpoint pen arrangement, as shown in FIG. 2, which comprises a barrel having an ink chamber on the inside to contain the ink, a tubular plug inserted into the barrel to hold a ballbearing and an absorbent rod. The absorbent rod continuously absorbs the ink, and then applies the ink to the steel ball in the ballbearing for writing. This ballpoint pen arrangement increases the ink holding capacity, however, it does not eliminate the leakage of the ink. Another problem of either of the aforesaid two ballpoint pen arrangement is that the ballpoint pen will become useless and shall be thrown away when the ink is used up. If the ballpoint pen of either structure is refilled with a different ink, the refilled ink may cause a chemical reaction with the residue of the ink previously used, to block the ink passage. Further, the assembly process of either ballpoint pen is complicated. It is difficult to control the best distance between the steel ball of the ballbearing and the tip of the absorbent rod. Since the distance between the tip of the absorbent rod and the steel ball of the ballbearing determines the flow rate of the ink to the steel ball, the ballbearing should be properly fastened to the absorbent rod, and accurately checked by an instrument after assembly.

SUMMARY OF THE INVENTION

The present invention eliminates the aforesaid drawbacks. It is therefore an object of the present invention to provide an ink guide for a ballpoint pen which allows the ballpoint pen to replaceably use different ink cartridges of different concentration. It is another object of the present invention to provide an ink guide for a ballpoint pen which has ink guiding channels to guide the ink to the ballbearing, which ink guiding channels are capable of guiding the ink back to the ink cartridge when the tip of the ink guide is saturated with the ink. It is still another object of the present invention to provide an ink guide which has a collar which automatically defines the distance between the tip thereof and the steel ball of the ballbearing according to a predetermined pitch. It is still another object of the present invention to provide an ink guide which has a buffer device to reduce the hydrodynamic pressure and flowing speed of the ink being guided to the ballbearing.

DETAILED DESCRIPTION OF THE PREFERRED EMBODIMENT

Figure 1:
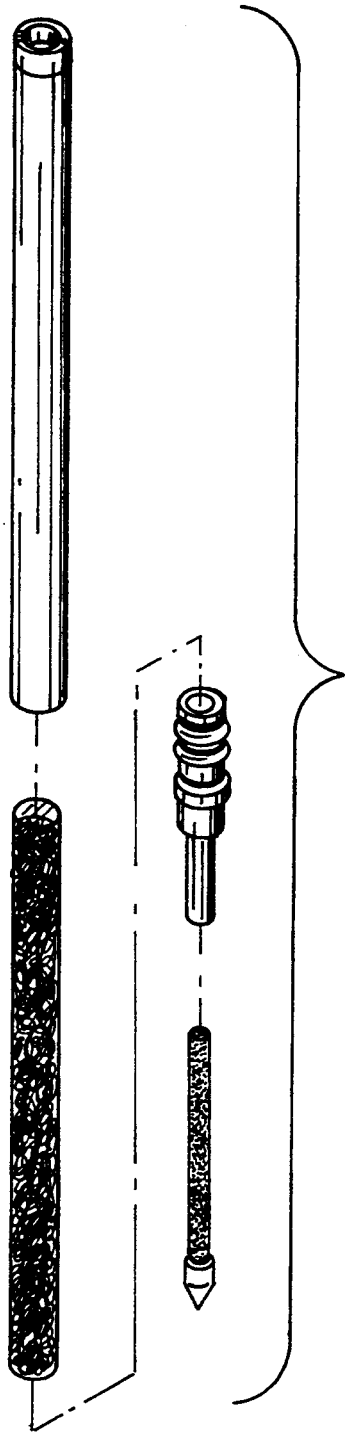
Fig. 1 (PRIOR ART)
FIG. 1 is a perspective exploded view of a ballpoint pen constructed according to the prior art.
Figure 2:
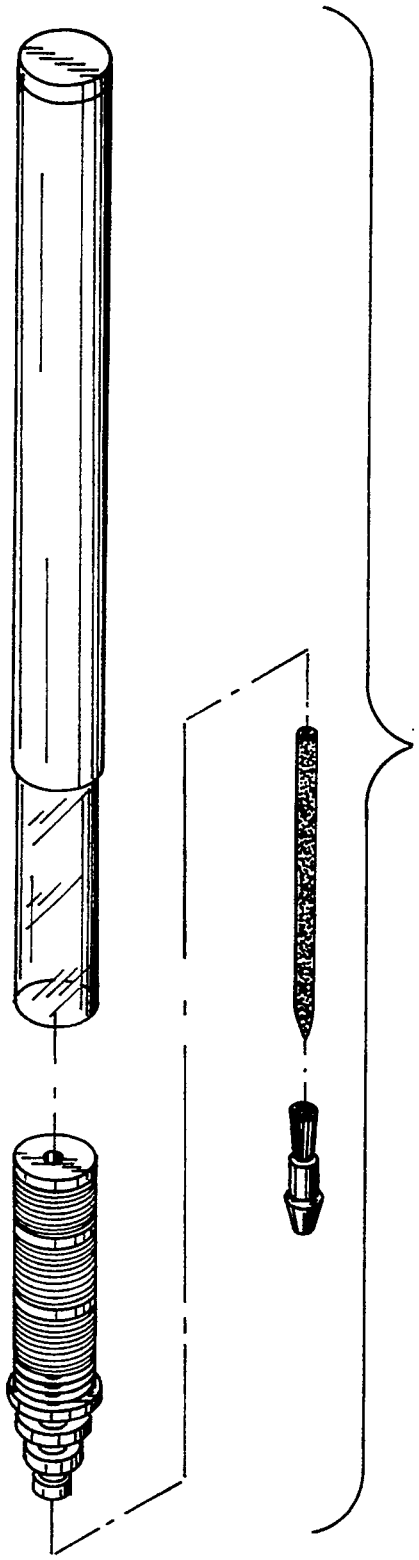
Fig. 2 (PRIOR ART)
FIG. 2 is a perspective exploded view of another structure of ballpoint pen constructed according to the prior art.
Figure 3:
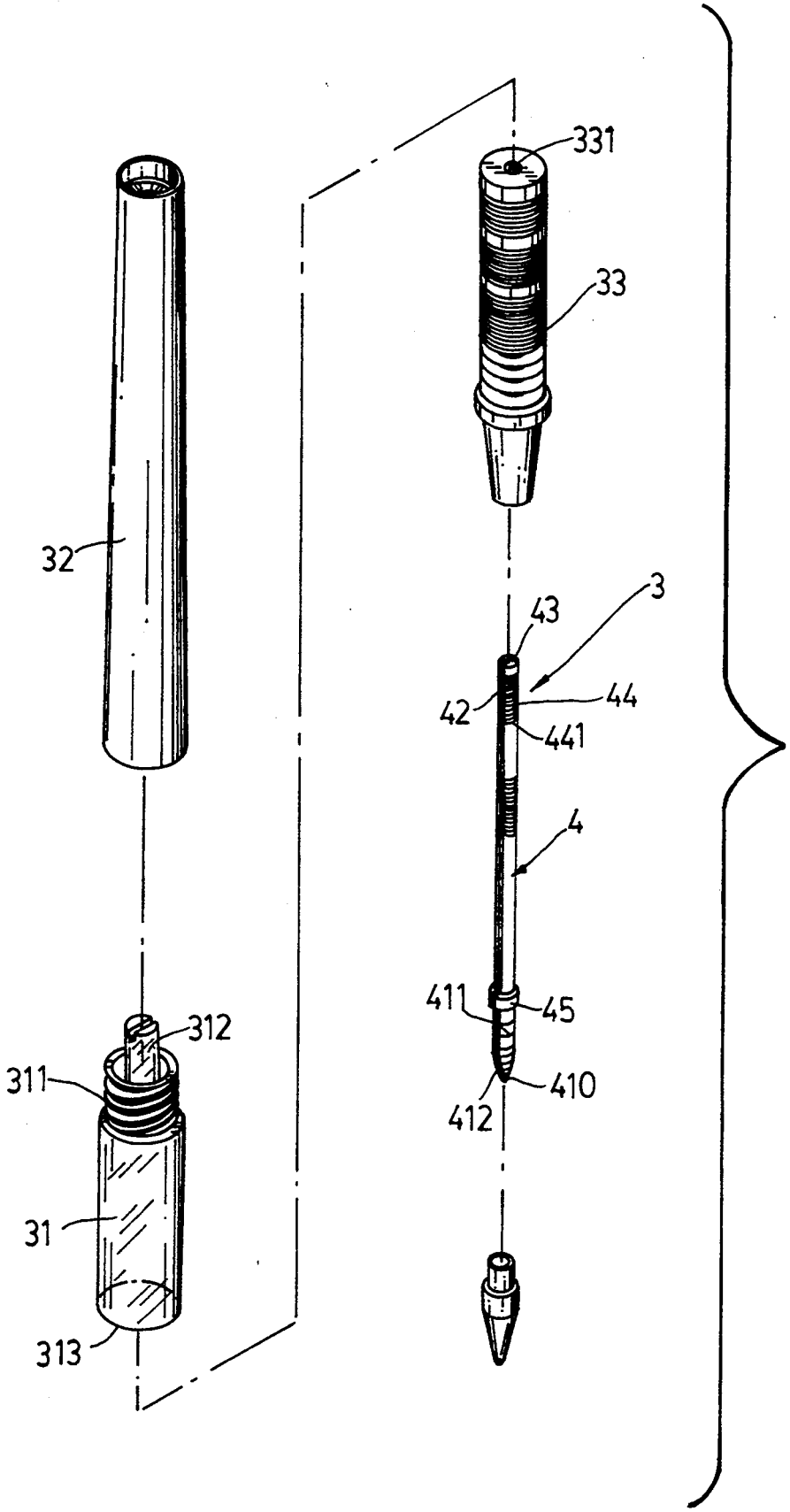
FIG. 3 is a perspective exploded view of a ballpoint pen constructed according to the preferred embodiment of the present invention.
Figure 4:
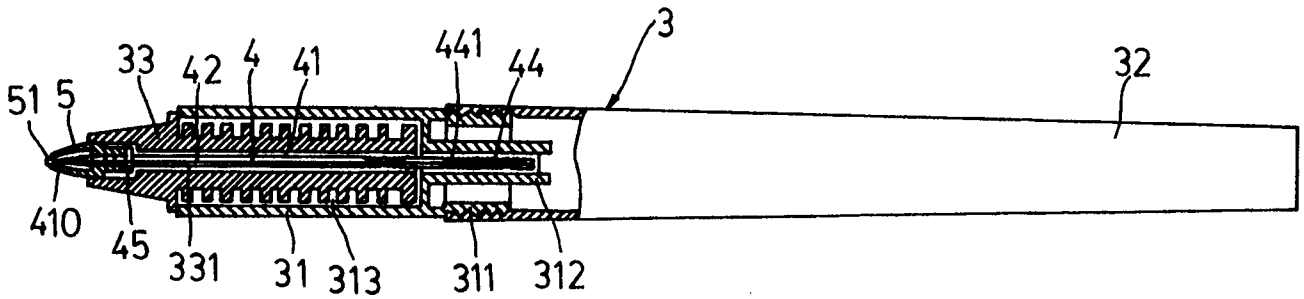
FIG. 4 is a longitudinal sectional assembly view of the ballpoint pen shown in FIG. 3.

Referring to FIGS. 3 and 4, the barrel 3 of a ballpoint pen constructed according to the preferred embodiment of the present invention is comprised of a front casing 31 and a rear casing 32. The front casing 31 has a front end formed into a socket 313, and a rear end formed into a connecting tube 312 surrounded by an outer thread 311. The rear casing 32 is adapted to hold an ink cartridge and is formed with an inner thread (not shown) at a front portion thereof into which the outer thread 311 of the front casing 31 threads. After the front casing 31 has been connected to the rear casing 32, the connecting tube 312 fits into the ink cartridge held in the rear casing 32 and functions to guide out the ink. A tubular plug 33 fits into the socket 313, and is provided with a central through hole 331 through its longitudinal center that is aligned with the connecting tube 312, and through which an elongated ink guide 4 is inserted into the connecting tube 312.

Figure 5:
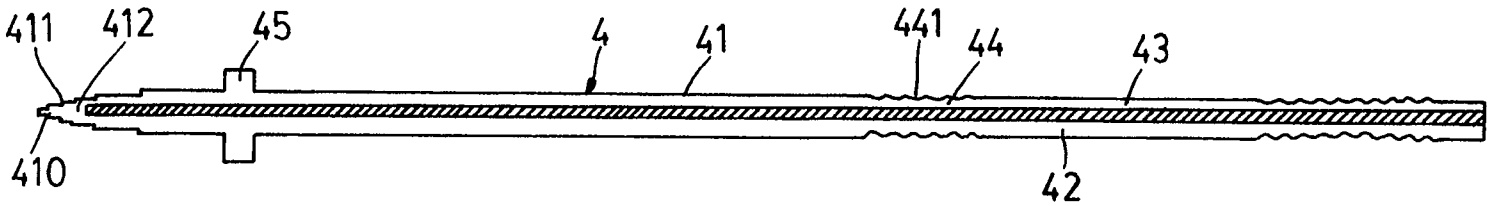
FIG. 5 is an enlarged longitudinal sectional view of an ink guide according to the present invention.

Referring to FIG. 5 and FIGS. 3 and 4 again, the ink guide 4 is comprised of an elongated casing 41 made from a non-absorbent material which does not cause any chemical reaction with the ink being used casing 41 includes at least one deep channel 42 and at least one shallow channel 43 respectively connected to the tip 410 of a stepped ink retaining portion 411, provided at the front end thereof by guide grooves 412. By means of the channels 42 and 43 and vents (not shown) provided on the tubular plug 33, the ink is smoothly guided from the ink cartridge in the rear casing 32 of the barrel 3 to the tip 410 of the stepped ink retaining portion 411. After the tip 410 has been saturated with the ink, the overflow of ink will be guided back to the ink cartridge through the shallow channel 43 due to a pressure difference. A buffer device 44 is formed on the elongated casing 41 to buffer the flowing speed of the ink to the tip 410. The buffer device 44 is comprised of a plurality of transverse grooves 441 respectively and bilaterally connected to the channels 42 and 43 at right angles. The buffer device 44 prevents the ink from directly flowing toward the tip 410, and therefore the pressure and speed of the flow of ink can be reduced. The stepped ink retaining portion 411 reserves a small amount of the ink as the ballpoint pen is hung on the pocket and not in use, and therefore an adequate supply of ink will be available. The ink guide 4 further comprises a collar 45, disposed at one end of the stepped ink retaining portion 411 and spaced from the tip 410, which locates the ballbearing 55 in place and defines the distance between the tip 410 and the steel ball 51 of the ballbearing 5.

While only one embodiment of the present invention has been shown and described, it will be understood that various modifications and changes could be made without departing from the spirit and scope of the invention.

What is claimed is:

1. An ink guide adapted to be positioned within a barrel of a ballpoint pen in order to guide ink from an ink cartridge within the pen directly to a ballbearing of the pen, said ink guide comprising:

an elongated casing made from a non-absorbent material;

an ink retaining portion formed adjacent a tip end of said casing;

first and second channels that extend longitudinally along said casing and merge at said ink retaining portion, said second channel being smaller in size than said first channel;

a plurality of guide grooves formed in said casing for guiding ink from said ink retaining portion to said tip end;

buffer means positioned along said casing for reducing the hydrodynamic pressure and flow speed of ink within said channels; and a collar carried by said casing and longitudinally spaced from said tip end for positioning said casing within a barrel of a ballpoint pen with said tip end being located in a predetermined spaced relationship relative to a ballbearing of the pen, whereby said ink guide is adapted to guide ink flowing from an ink cartridge of a ballpoint pen to said ink retaining portion and said tip end and, when said tip end is saturated with ink, to automatically guide an overflow amount of ink back to the ink cartridge through said second channel.

2. The ink guide of claim 1, wherein said buffer means comprises a plurality of transverse grooves on said casing that are respectively connected to said first and second channels at right angles.

3. The ink guide of claim 1, wherein said first and second channels have different profiles.

4. The ink Wide of claim 1 wherein said ink retaining portion of said casing is rode in the shape of a stepped rod gradually reducing toward said tip.

* * * * *